US006597326B2

(12) United States Patent
Chen

(10) Patent No.: US 6,597,326 B2
(45) Date of Patent: Jul. 22, 2003

(54) STRUCTURE OF HELIX ANTENNA

(75) Inventor: I-Fong Chen, Tao-Yuan (TW)

(73) Assignee: Auden Techno Corp., Taoyuan Hsien (TW)

( * ) Notice: Subject to any disclaimer, the term of this patent is extended or adjusted under 35 U.S.C. 154(b) by 0 days.

(21) Appl. No.: 10/024,710

(22) Filed: Dec. 21, 2001

(65) Prior Publication Data

US 2003/0117338 A1 Jun. 26, 2003

(51) Int. Cl.[7] ..... H01Q 1/24
(52) U.S. Cl. ..... 343/895; 343/702
(58) Field of Search ..... 343/702, 715, 343/895, 900, 906; H01Q 1/24, 1/36

(56) References Cited

U.S. PATENT DOCUMENTS 5,742,259 A * 4/1998 Annamaa ..... 343/895
6,218,993 B1 * 4/2001 Chao et al. ..... 343/702
6,337,669 B1 * 1/2002 Chiang ..... 343/895
6,340,955 B1 * 1/2002 Chao ..... 343/895
6,344,827 B1 * 2/2002 Wu ..... 343/702
6,369,775 B1 * 4/2002 Moore et al. ..... 343/893

* cited by examiner

*Primary Examiner*—Tho Phan
(74) *Attorney, Agent, or Firm*—Troxell Law Office PLLC

(57) ABSTRACT

A structure of a helix antenna, wherein a non-uniform helical coil is press positioned between an inner insulating sleeve and an external insulating sleeve slipping one over the other, the coil is abutted respectively against the inner top surface of the external insulating sleeve and a metallic connecting seat of the inner insulating sleeve. A metallic contact piece is abutted against the metallic connecting seat, has a continuous bending portion exposed from a side slit on the inner insulating sleeve, and has a bottom end for press contacting an RF electric circuit of a communication instrument. The coil has on the top end a diametrically extending bent section to be an added loading of the antenna, the bottom end of the coil has a denser coil section positioned on the surface of the metallic connecting seat. The inner and external insulating sleeves have an external protruding annulus engaged with an inner annular recess for assembling the helical coil to have a fixed length.

4 Claims, 12 Drawing Sheets

STRUCTURE OF HELIX ANTENNA

BACKGROUND OF THE INVENTION

1. Field of the Invention

The present invention is related to a structure of a helix antenna, and especially to an antenna which suits a communication instrument, by cooperation of the related members thereof, a fixed length, a loading added to the antenna and impedance matching of an inner helix coil make it surely suit two or multiple frequencies.

2. Description of the Prior Art

Coils used as signal receiving and emitting elements are well known, the coil pitch and the coil diameter of a conventional helix antenna are both fixed, and can only be used for a single frequency. However, frequencies used nowadays for communication instruments (such as a mobile phone) are all of two or multiple frequencies. It needs frequency matching to make a conventional helix antenna suit two or multiple frequencies. Nevertheless, this generally involves more complicated structures and higher cost of production.

Thereby, Ericsson company No. W 098/15028 provided a multi band non-uniform helical antenna, the pitch angle, coil diameter, number and spacing of the coil turns of the helical antenna are set ununiform in order to get the-function of two or multiple frequencies. For example, the helical coil has a section with a denser group of turns, and has another section with a looser group of turns; alternatively, a section can be of a larger coil diameter, while the other section can be of a smaller coil diameter; in these modes, different lengths can be used for different consonant frequencies (such as 900 MHZ and 1800 MHZ).

However, the content disclosed in this patent shows that the helical coil is not compressed, and its antenna can not be added to with a top loading, such as is shown in FIG. 1, it can not obtain the desired VSWR. Even if it is added with a top loading, such as is shown in, FIG. 2, the desired VSWR still can not be obtained. Only when the non-uniform helical antenna is compressed, the desired VSWR can be obtained. When the frequency is 880 MHZ, its VSWR is 4.33.

SUMMARY OF THE INVENTION

The object of the present invention is to provide a structure of a helix antenna, wherein, a load can be added on the top of a non-uniform helical coil, in cooperating with a fixed length of the helical coil formed by melting connecting the inner to the outer insulating sleeves, as well as with the impedance matching of a metallic connecting seat on the bottom thereof with an elastic contact piece, to construct a brand-new dual or multi-frequency helix antenna.

In the preferred embodiment, the top of the helical coil is extended toward the center thereof with a length to be an added loading of the antenna.

In a practicable preferred embodiment, the inner and the outer insulating sleeves of the antenna is provided respectively with an annular recess and an external protruding annulus able to matchably connect with each other for melting connecting with each other, so that the helical coil can be assembled to have a fixed length of a predetermined type.

The bottom of the helical coil has a dense section of turns assembled on the metallic connecting seat to make impedance matching with the elastic contact piece.

The present invention will be apparent in its novelty and other characteristics after reading the detailed description of the preferred embodiment thereof in reference to the accompanying drawings.

DETAILED DESCRIPTION OF THE PREFERRED EMBODIMENT

Figure 1:
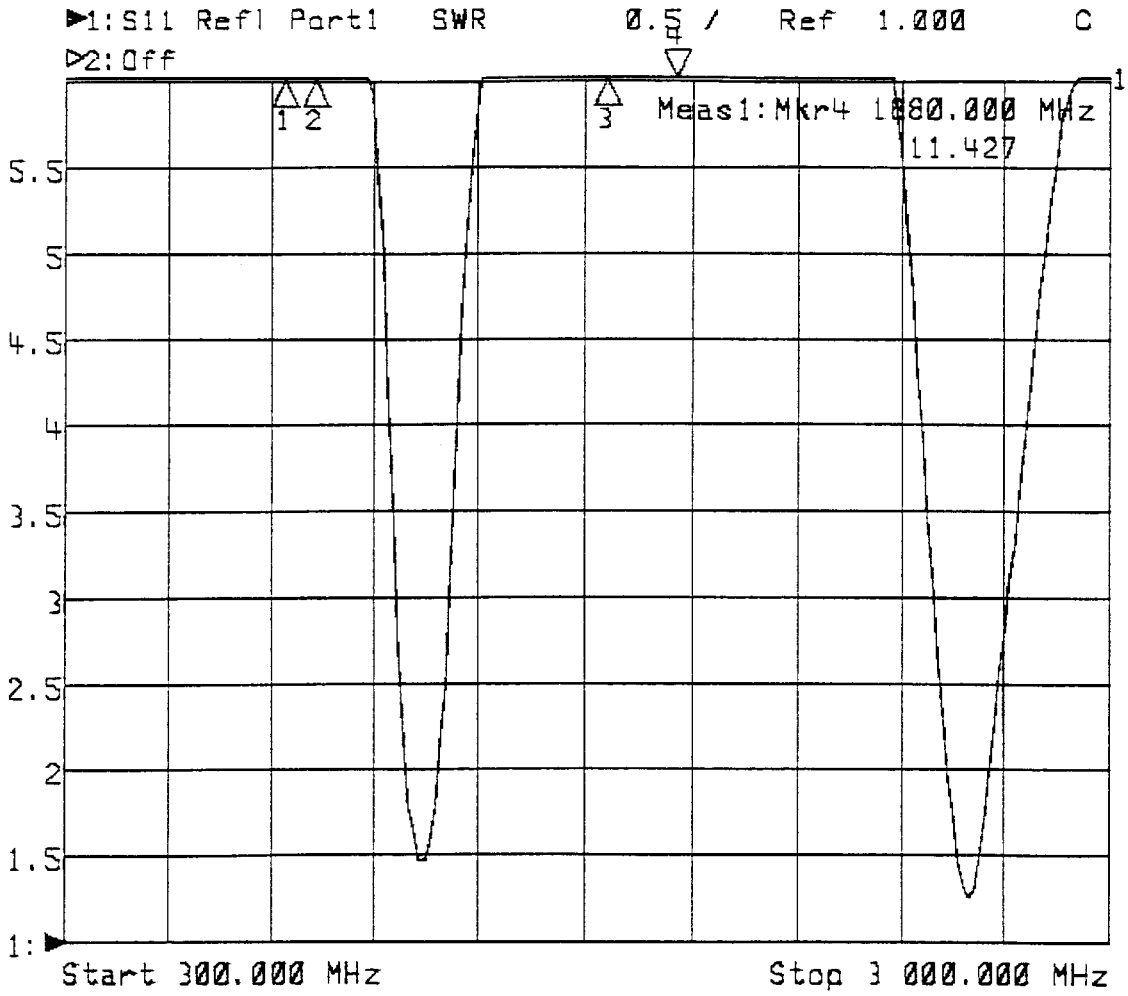
FIG. 1 PRIOR ART
FIG. 1 is a test chart of VSWRs of different dense sections of turns and loose sections of turns used for a helical coil.
Figure 2:
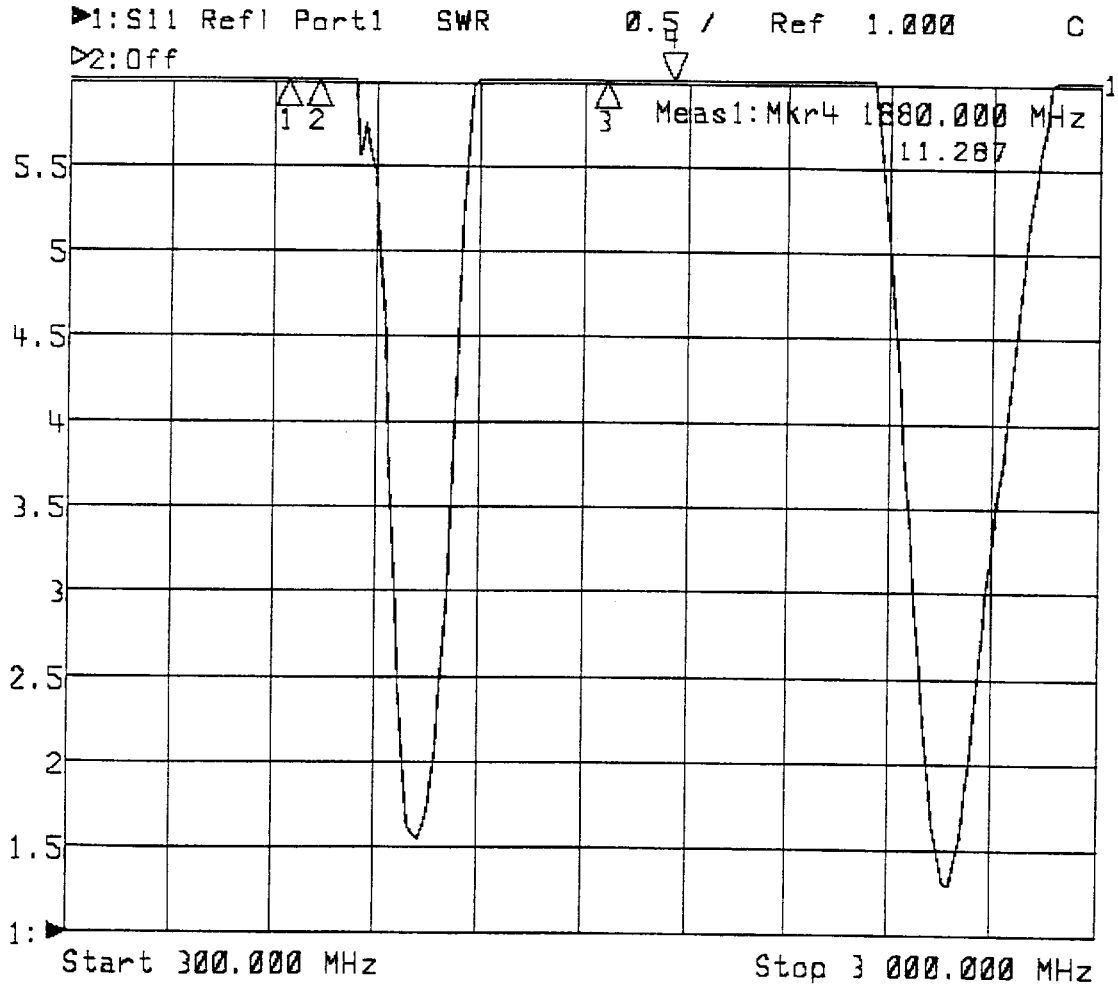
FIG. 2 PRIOR ART
FIG. 2 is a test chart of VSWRs of the case of FIG. 1 when the top of the coil is added with a loading.
Figure 3:
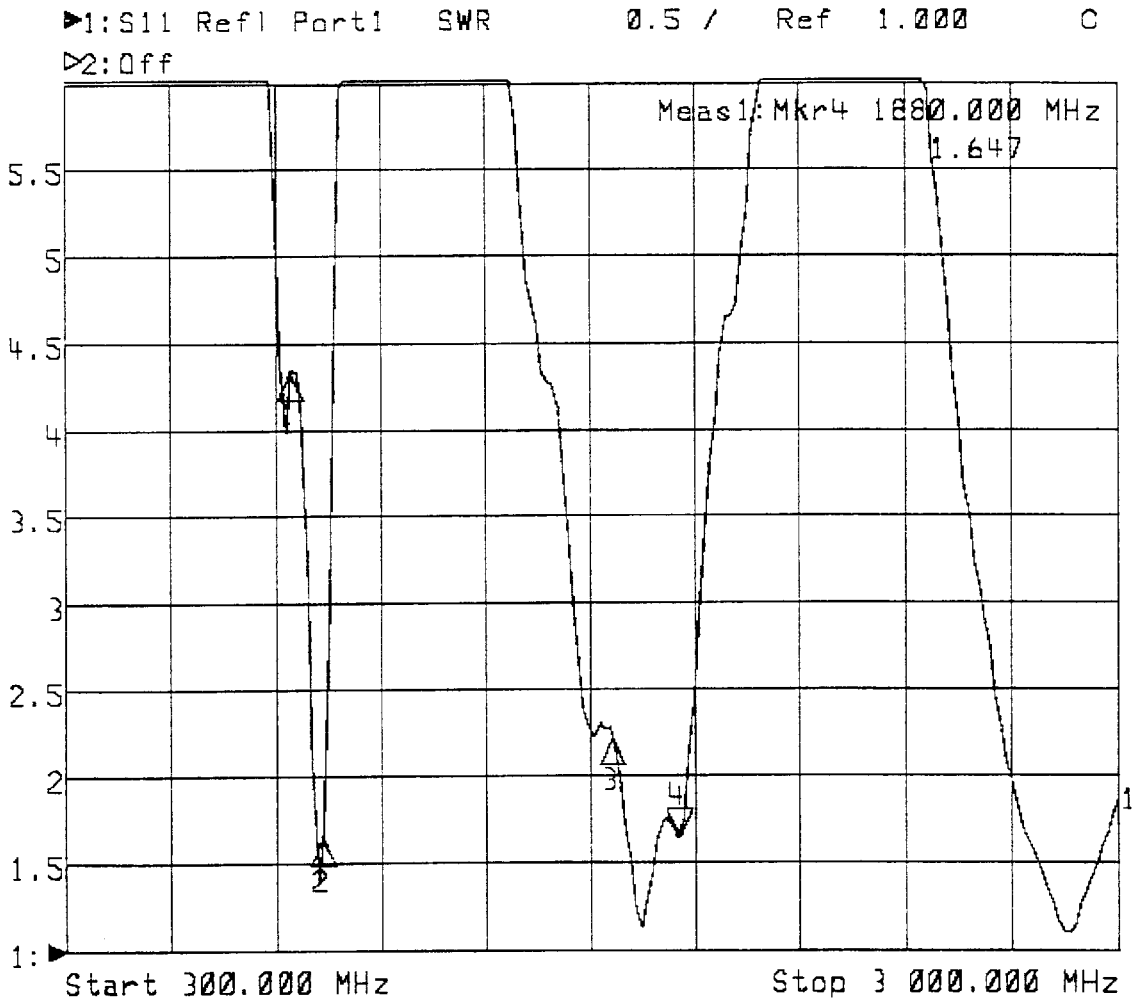
FIG. 3 PRIOR ART
FIG. 3 is a test chart when the helical coil of FIG. 2 is compressed.
Figure 4:
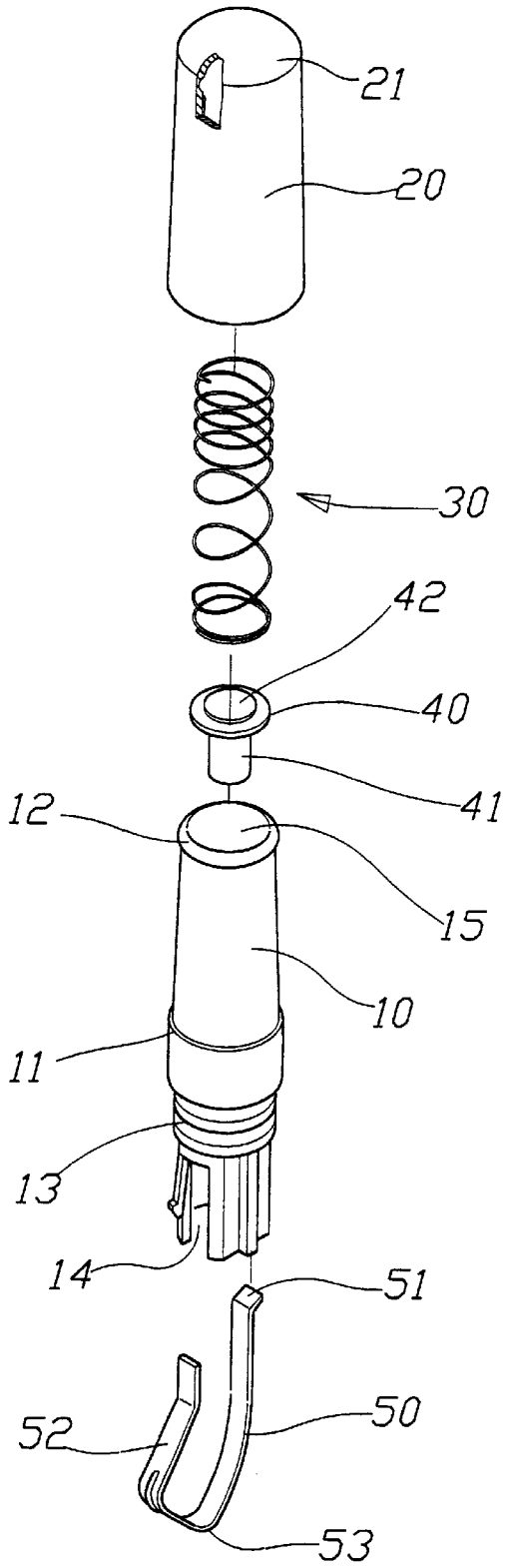
FIG. 4 is an anatomic perspective view showing the elements of a preferred embodiment of the present invention.
Figure 5:
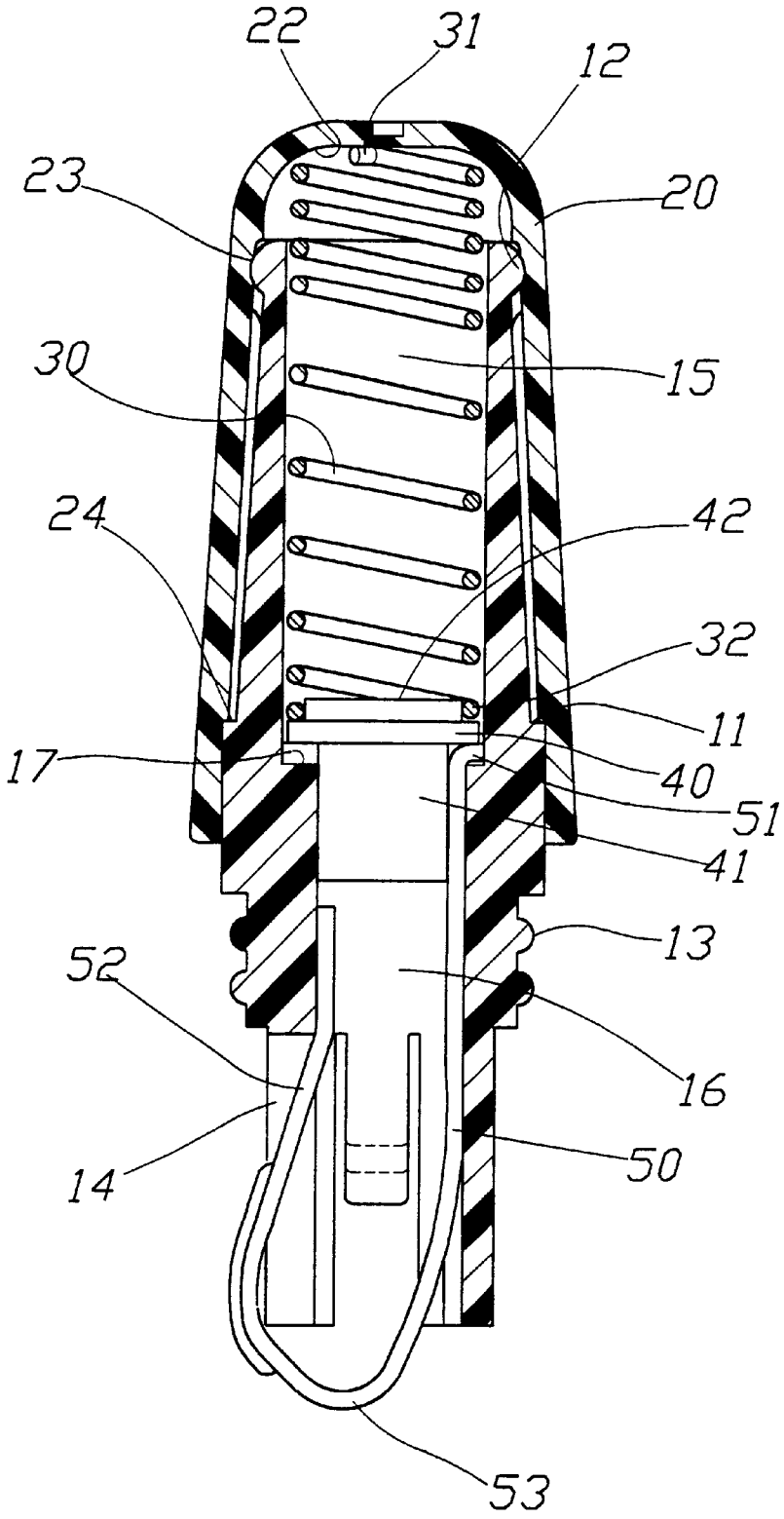
FIG. 5 is a sectional view taken from FIG. 4 after assembling.

Referring to FIGS. 4 and 5, the whole antenna of the present invention generally is comprised of an inner insulating sleeve 10, an external insulating sleeve 20, a helical coil 30 to be placed in the insulating sleeve 10, a metallic connecting seat 40 and an elastic metallic contact piece 50.

In the preferred embodiment shown, the inner insulating sleeve 10 has a main hollow body with a suitable size and diameter, and is provided with an external middle stepped portion 11, a top external protruding annulus 12, a bottom insertion connecting portion 13 and a side slit 14; and is provided internally with a first through hole 15 and a second through hole 16 in communicating with the first through hole 15 to form an inner stepped portion 17 between them (referring to FIG. 5).

The external insulating sleeve 20 is slipped over the inner insulating sleeve 10 and has a top surface 21 and a down facing opening. The external insulating sleeve 20 is provided with an inner annular recess 23 at a location slightly lower than the top surface 22 thereof and in cooperation with the external protruding annulus 12, and is provided with an inner annular stepped portion 24 in cooperation with the external stepped portion 11.

The metallic connecting seat 40 has an extending rod 41 below the main plate thereof, and a raised portion 42 on the surface thereof with a diameter smaller than that of the main plate. So that the entire metallic connecting seat 40 can be assembled at the bottom in the first through hole 15 of the inner insulating sleeve 10 to render the extending rod 41 to extend into the second through hole 16.

Figure 7:
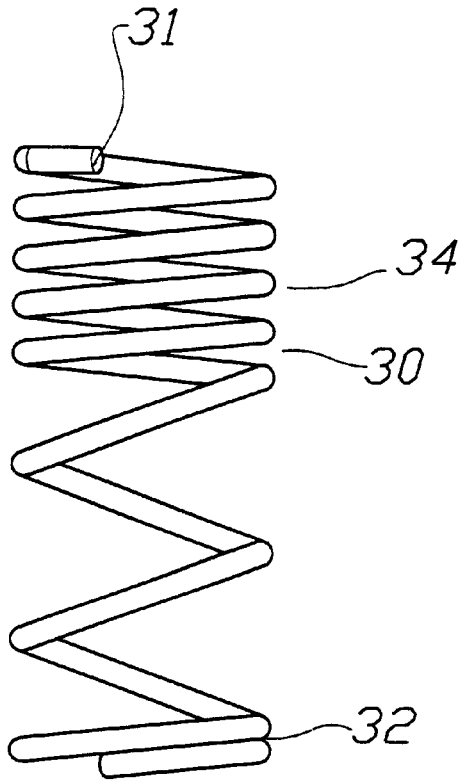
FIG. 7 is a top view taken from FIG. 6.
Figure 8:
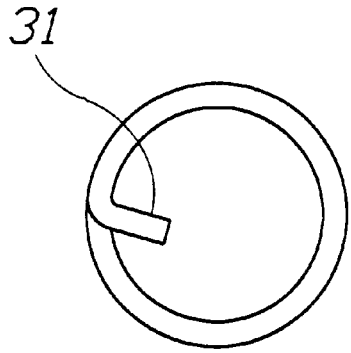
FIG. 8 is a sectional view showing mounting of the present invention on the top end of a communication instrument.
Figure 9A:
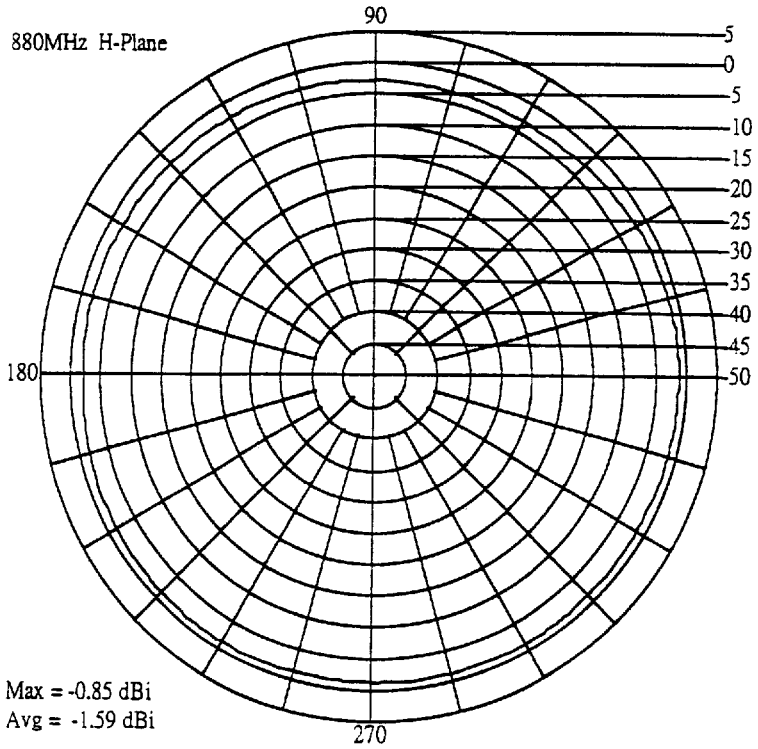
FIGS. 9*a*–12*b* are diagrams of electromagnetic fields when the frequency of the present invention is respectively 880 MHZ, 960 MHZ, 1710 MHZ and 1880 MHZ.
Figure 9B:
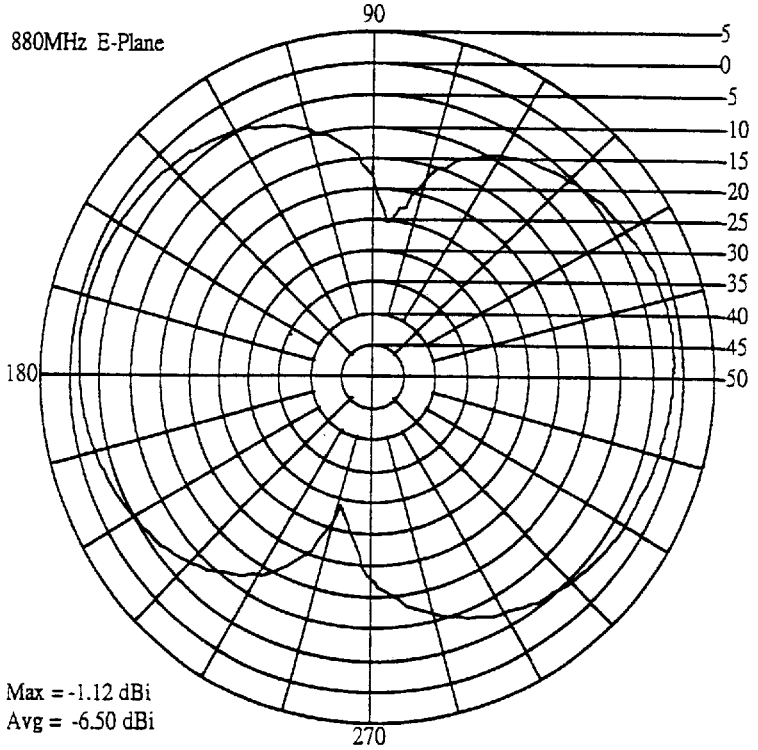
Figure 10A:
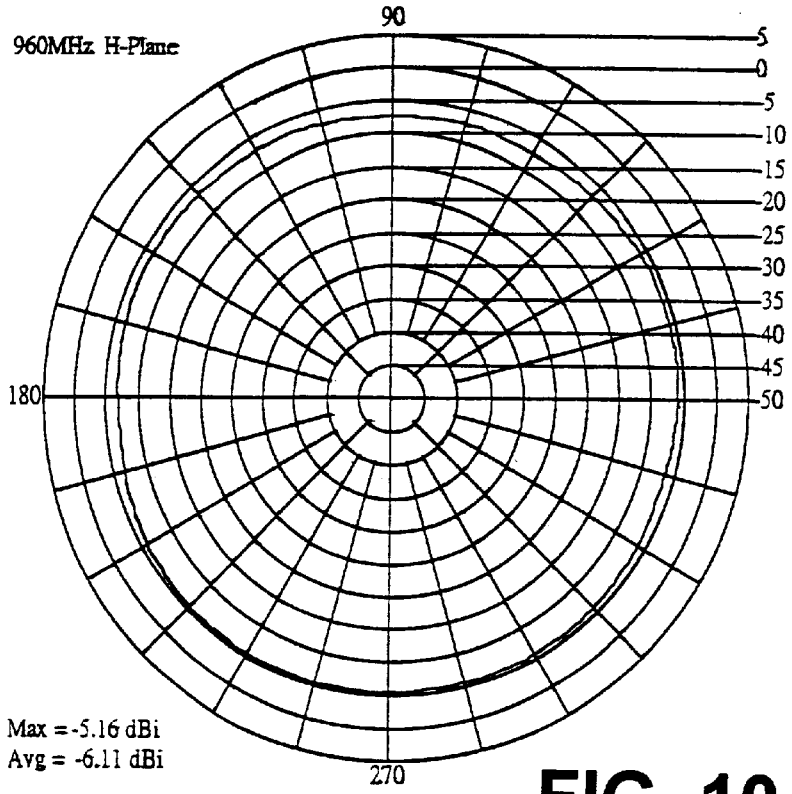
Figure 10B:
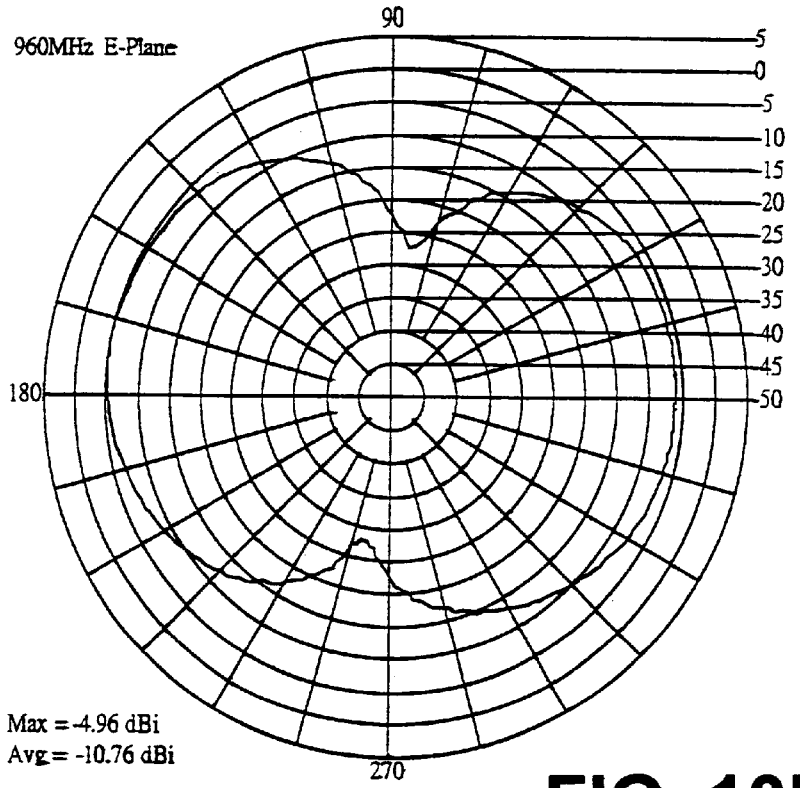
Figure 11A:
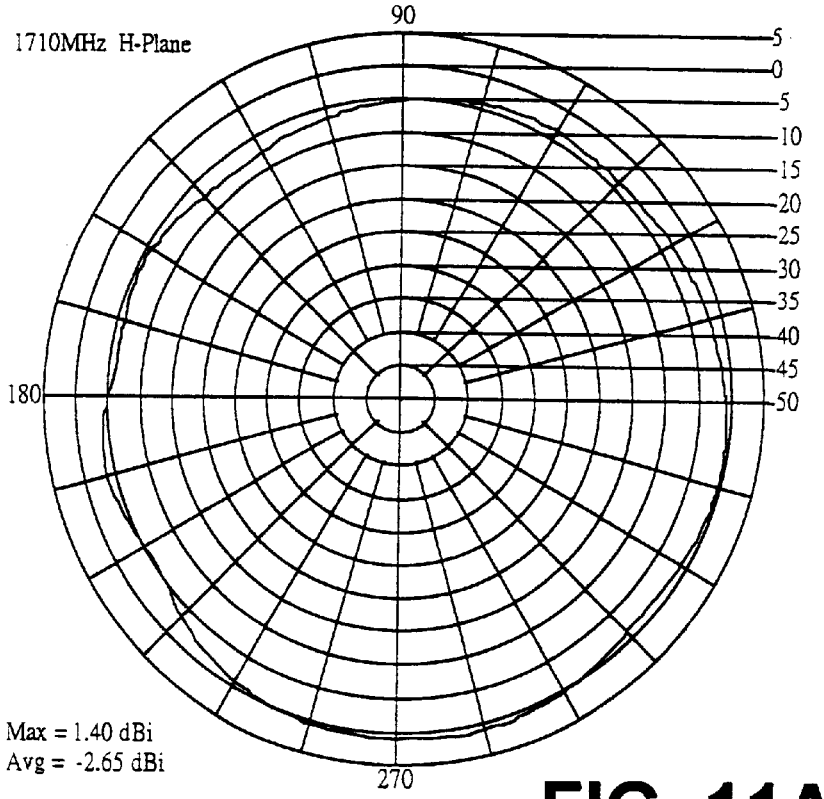
Figure 11B:
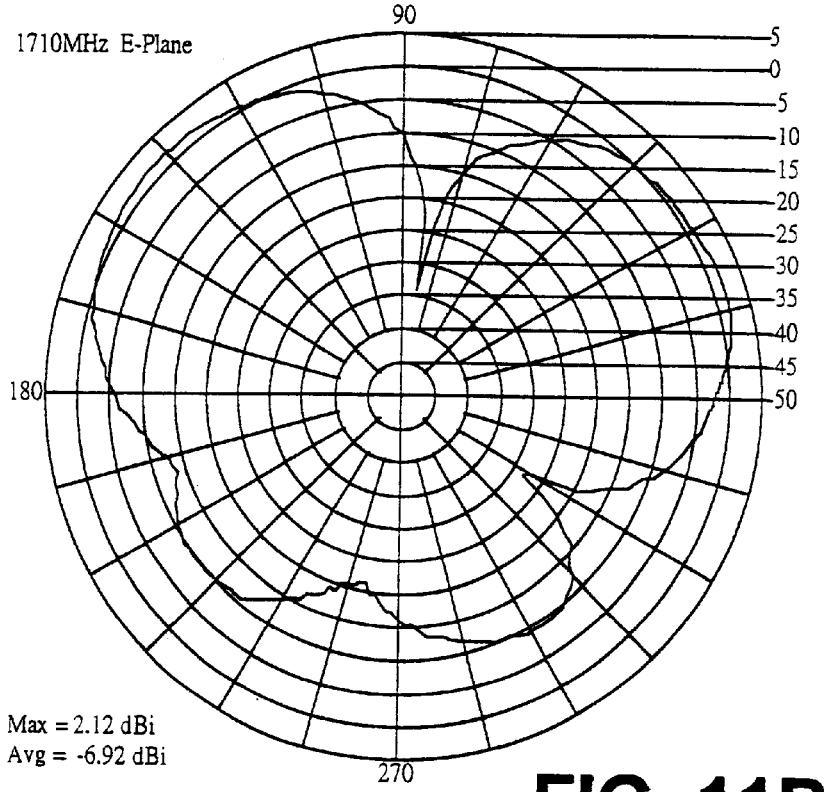
Figure 12A:
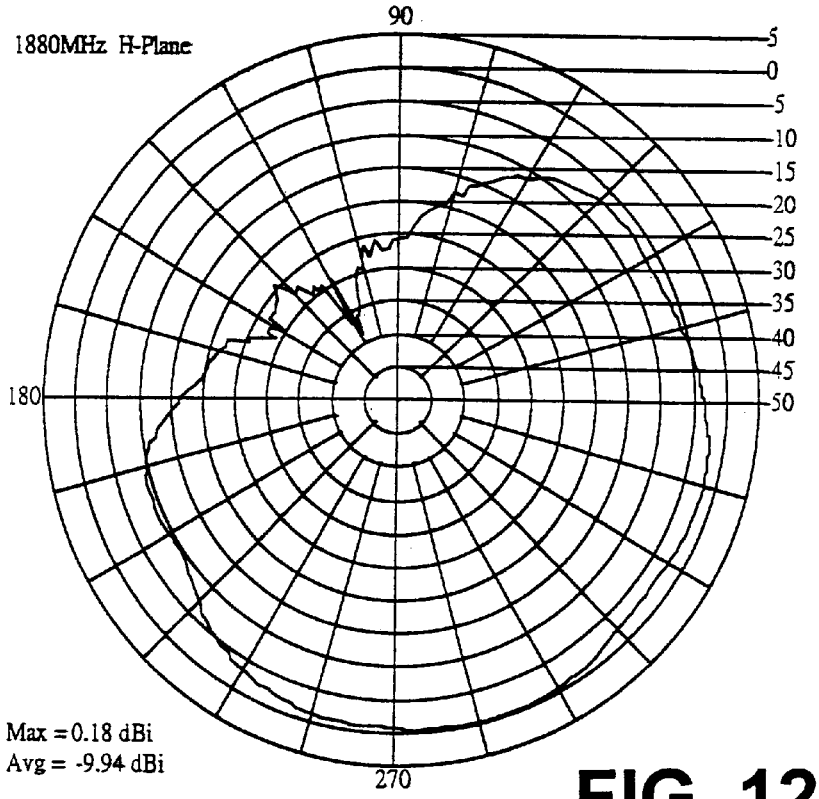
Figure 12B:
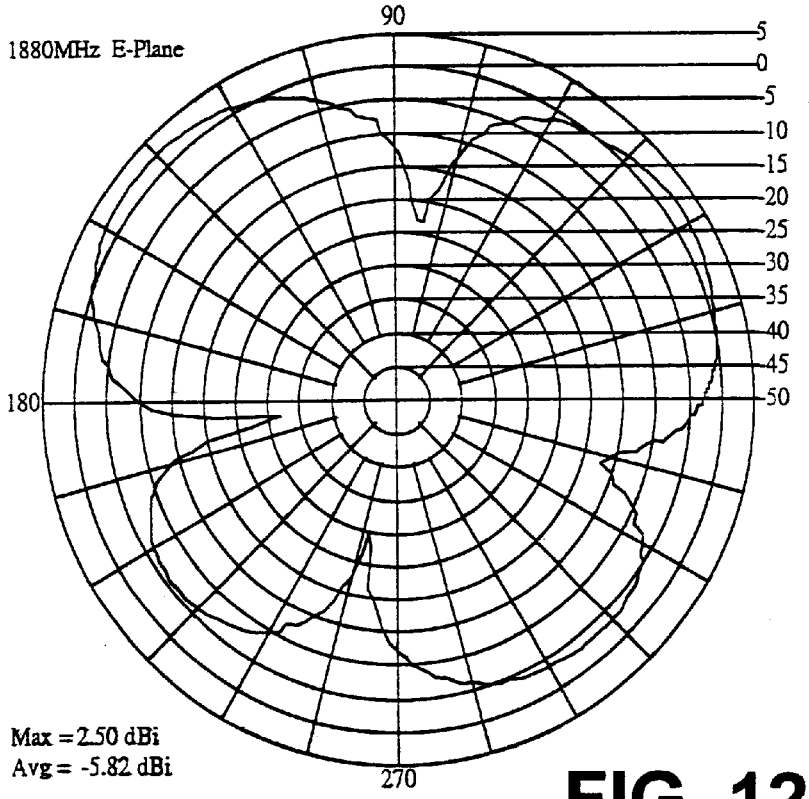

The helical coil 30 is non-uniform spring and is provided between the metallic connecting seat 40 and the top surface 22 of the external insulating sleeve 20. In the embodiment shown, the helical coil 30 is comprised of a denser coil section 34 on the upper end thereof and a lower looser coil section. As shown in FIGS. 7 and 8, the top end of the upper denser coil section is folded to extend toward the center thereof to form a bent section 31 to be an added loading of the antenna; the bottom end of the helical coil 30 is provided with a denser positioning coil section 32 which tightly wraps around the raised portion 42 of the metallic connecting seat 40.

Figure 6:
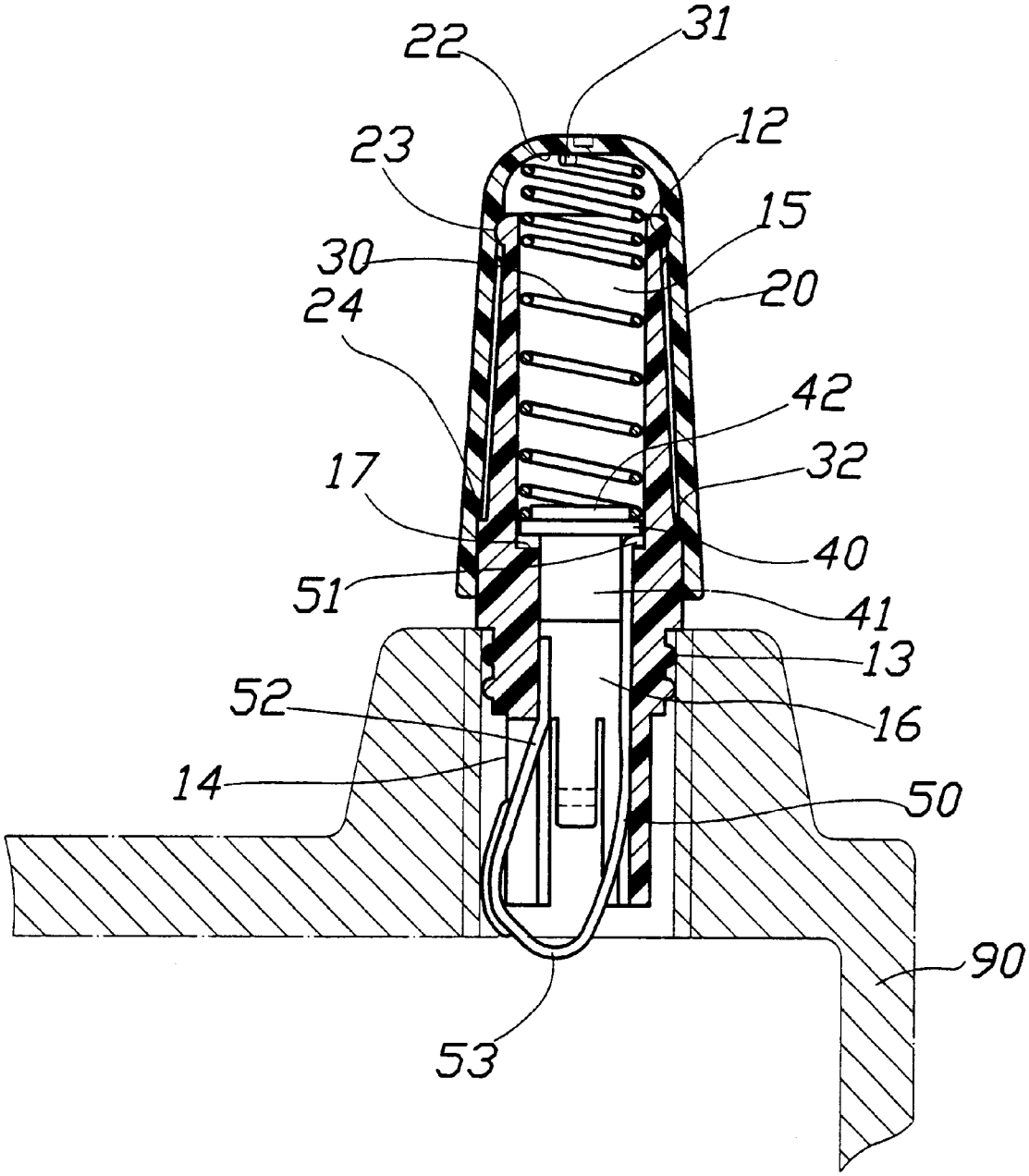
FIG. 6 is a sectional view showing the embodiment in FIG. 4 is used on a communication instrument.

The elastic metallic contact piece 50 has at least an upper folded portion 51 to be press connected between the metallic connecting seat 40 and the inner stepped portion 17 of the inner insulating sleeve 10. The elastic metallic contact piece 50 further has a continuous bending portion 52 which can be elastically pressed against the second through hole 16 of the inner insulating sleeve 10 and is exposed partially from the side slit 14 of the inner insulating sleeve 10. And a press contacting bottom end 53 is provided on the elastic metallic contact piece 50 for press contacting the antenna line in a communication instrument 90 when in assembling (referring to FIG. 6).

After slip bushing of the external insulating sleeve 20 over the inner insulating sleeve 10, engagement between the external protruding annulus 12 and the inner annular recess 23 is done; and after the inner stepped portion 24 is abutted on and melted together with the external stepped portion 11, the helical coil 30 is assembled in the antenna under pressure with its coil pitch and fixed length set, and its function can be assured. The top bent section 31 is an essential added loading of the antenna, the denser positioning coil section 32 and the metallic connecting seat 40 are provided for impedance matching.

The diameter of the above stated helical coil 30 is preferably 1350 MHZ 0.04λ, 1350 MHZ is the middle frequency between the two frequencies 900 MHZ and 1800 MHZ. In this way, the half-power beam-width can be adjusted to about 90°.

The metallic connecting seat 40 and the elastic metallic contact piece 50 in cooperation with the abovementioned denser positioning coil section 32 can have their harmonic frequencies adjusted to form two or multiple functions. In the embodiment of two frequencies, the entire length of the metallic connecting seat 40 together with the elastic metallic contact piece 50 is 1350 MHZ ¼λ(≅6.1cm)

Figure 13:
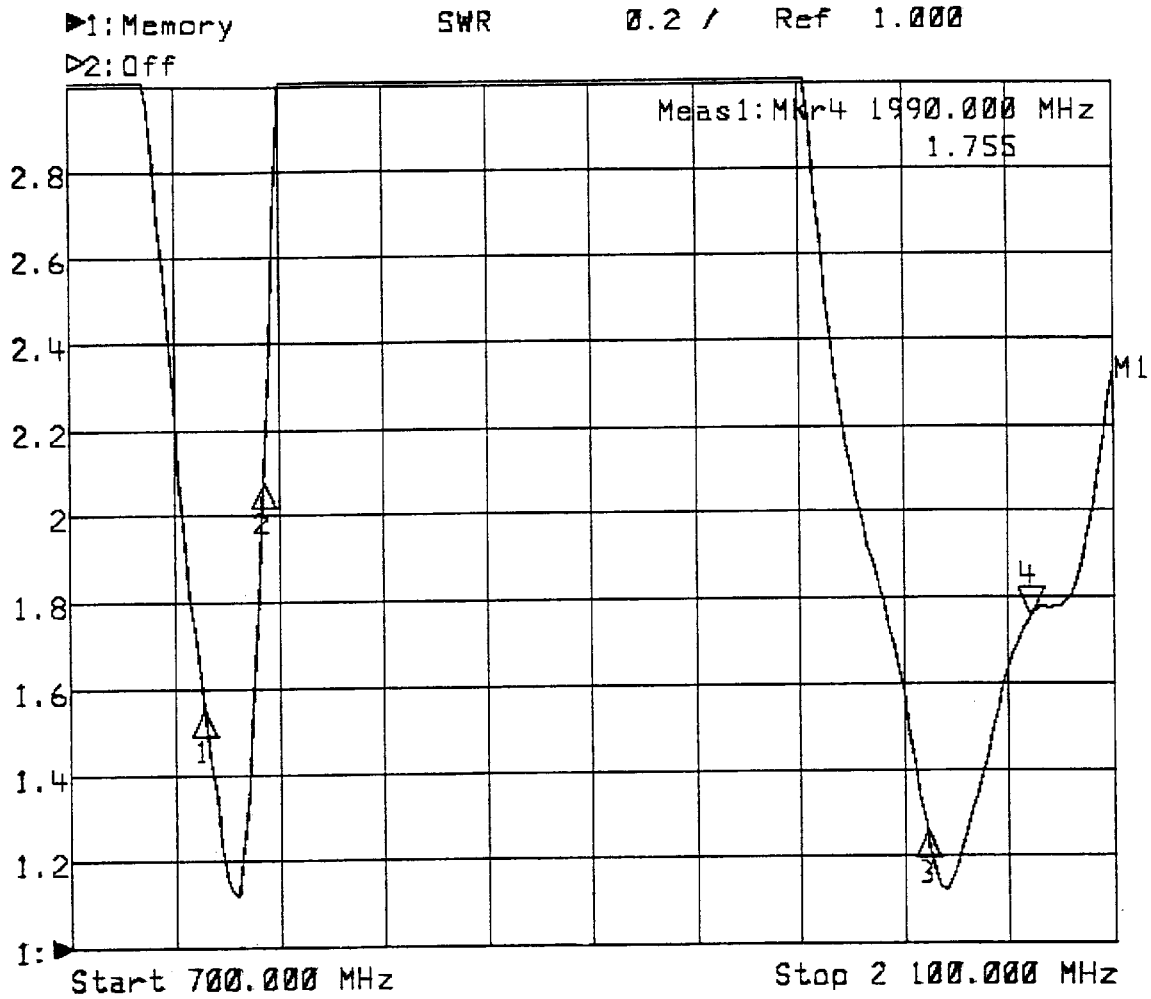
FIG. 13 is a test chart of VSWRs of the present invention.

FIGS. 9–12 respectively show the diagrams of electromagnetic fields when the frequencies of the present invention are respectively 880 MHZ, 960 MHZ, 1710 MHZ and 1880 MHZ. And FIG. 13 is a test chart of VSWRs of the present invention under these frequencies, the VSWRs for these frequencies are very ideal when they are all under 2.

The preferred embodiment disclosed above is only for illustrating the present invention. It will be apparent to those skilled in this art that various modifications or changes can be made to the elements of the present invention without departing from the spirit and characteristic of this invention. Accordingly, all such modifications and changes also fall within the scope of the appended claims and are intended to form part of this invention.

What is claimed is:

1. A structure of a helix antenna, comprising: a non-uniform helical coil press positioned between an inner insulating sleeve having an external protruding annulus at a top portion, and an external insulating sleeve having an inner annular recess, the helical coil abutting against an inner top surface of the external insulating sleeve; a metallic connecting seat located in the inner insulating sleeve; an elastic metallic contact piece having a first end abutting against the metallic connecting seat, a second end including a continuous bending portion which is exposed from a side slit in the inner insulating sleeve, and a bottom end for press contacting with an RF electric circuit of a communication instrument; the helical coil having a top end with a diametrically extending bent section to provide added loading to the antenna, a bottom end of the helical coil having a dense coil section positioned oh a surface of the metallic connecting seat; the inner and external insulating sleeves are fixedly connected by inserting the external protruding annulus on the inner insulating sleeve into the inner annular recess on the external insulating sleeve thereby fixing the length of the helical coil.

2. The structure of a helix antenna according to claim 1, wherein a top portion of the helical coil has a denser coil section than a lower portion of the helical coil.

3. The structure of a helix antenna according to claim 1, wherein the helical coil is a dual frequency helical coil with a diameter 1350 MHZ 0.04λ, in which 1350 MHZ is the middle frequency between two frequencies 900 MHZ and 1800 MHZ of the helical coil.

4. The structure of a helix antenna according to claim 1, wherein the entire length of said metallic connecting seat together with the elastic metallic contact piece is 1350 MHZ ¼λ.

* * * * *